United States Patent [19]

Ogawa et al.

[11] Patent Number: 4,856,443

[45] Date of Patent: Aug. 15, 1989

[54] NEEDLE THREAD TENSIONING DEVICE FOR A SWING MACHINE

[75] Inventors: Masao Ogawa, Nagoya; Noboru Ito, Oogaki; Yukio Yamamura, Nagoya, all of Japan

[73] Assignee: Okamura & Co., Osaka, Japan

[21] Appl. No.: 193,553

[22] Filed: May 13, 1988

[30] Foreign Application Priority Data

May 15, 1987 [JP] Japan ..... 62-119897
May 15, 1987 [JP] Japan ..... 62-119898

[51] Int. Cl.[4] ..... D05B 49/00; D05B 57/00; D05B 47/00

[52] U.S. Cl. ..... 112/241; 112/184; 112/302

[58] Field of Search ..... 112/241, 182, 184, 247, 112/302

[56] References Cited

U.S. PATENT DOCUMENTS 3,476,067 11/1969 Johnson ..... 112/241 X
3,641,958 2/1972 Trageser ..... 112/241
4,006,699 2/1977 Matsuda ..... 112/241
4,263,859 4/1981 Johnson ..... 112/184
4,356,781 11/1982 Rodda ..... 112/184

FOREIGN PATENT DOCUMENTS 813229 5/1959 United Kingdom .

*Primary Examiner*—Andrew M. Falik
*Attorney, Agent, or Firm*—Barnes & Thornburg

[57] ABSTRACT

A thread checking device is installed in combination with a sewing machine in order to exert a proper tension on the thread loop formed at the eye of the needle when the thread loop passes through betweeen the bobbin case and the rotation stopping member for restraining rotation of the bobbin case. This thread checking device is provided with thread suspending means which comprises a thread suspending part disposed near a specified position where the thread guide of the thread take-up member is located when the needle thread loop passes between the bobbin case and the rotation stopping member. The thread suspending means suspends the needle thread held on the thread guide with the suspending part when the take-up member moves from the maximum thread take-up position to the maximum thread slack position.

8 Claims, 9 Drawing Sheets

NEEDLE THREAD TENSIONING DEVICE FOR A SWING MACHINE

BACKGROUND OF THE INVENTION

The present invention relates to an auxiliary thread take-up device of a sewing machine, and in particular to a device wherein a thread suspending means is provided near a specified position where a thread guide of a take-up member is located when a needle thread loop passes between a bobbin case and a rotation stopping member thereof in order to suspend a needle thread held by the thread guide during the downward movement of the take-up member.

In a conventional sewing machine, for example as shown in FIG. 15, a thread take-up spring 4 in a spiral form is mounted in association with a spring force adjusting mechanism 3 at the turning point of a needle thread fed from the thread guide 2 of the thread take-up lever 1. Alternatively, a thread take-up spring 5 in a straight form is used in conjunction with, the spring force adjusting mechanism 3, as shown in FIGS. 16 and 17. In these cases, the thread take-up springs 4, 5 are compressed to absorb an extra amount of the needle thread when the take-up lever is elevated near its uppermost position to tighten the thread, and these springs 4 or 5 release the needle thread when the take-up lever descends. Further, these spring 4 and 5 functions to take out the needle thread smoothly from the loop taker in the middle of elevating motion of the take-up lever. The thread take-up spring 4 or 5 is a soft spring such that it will not release an extra amount of the needle thread 6 when the take-up lever is in the vicinity of the upper most position and that it will not effect thread-tightening by its spring force when stitching a thin fabric. Such a thread take-up spring was required to be capable of following the stitching speed of a sewing machine. Accordingly, the thread take-up spring was necessarily provided with the spring force adjusting mechanism 3 for adjusting its spring force.

Consequently, such a spring force adjusting mechanism made the structure of the sewing machine complicated, and since it was required to adjust the spring force adequately according to the type of a work fabric to be sewn or the type of the needle thread to be used, sewing operation necessitated substantially high skills.

SUMMARY OF THE INVENTION

A primary object of the present invention is to leave out the spring adjusting mechanism for the thread take-up spring so as to simplify operation of the sewing machine. Another object of the present invention is to make it possible to take the needle thread smoothly out of the rotating looptaker and also to decrease noise generated upon taking out the needle thread.

An auxiliary thread take-up device according to the present invention is for use in a sewing machine having an endwise reciprocatory needle with an eye; a bobbin with the bobbin thread; a rotating looptaker having a bobbin case which contains the bobbin and is restrained not to rotate with a rotation stopping member, a looptaker which is rotated to seize and enlarge a needle thread loop formed at the eye of the needle; and a thread take-up member movable between a maximum thread slack position and a maximum thread take-up position and provided with a thread guide.

The above-described auxiliary thread take-up device, at least, comprises a thread suspending means which is provided with a thread suspending part disposed near a specified position where the thread guide of the thread take-up member is located when the needle thread loop passes between the rotation stopping member and the bobbin case and suspends the needle thread held on the thread guide with the suspending part when the thread take-up member moves from the maximum thread take-up position to the maximum thread slack position.

With such an auxiliary thread take-up device as arranged, when the thread take-up member is moved within a determined range from the maximum thread take-up position to the maximum thread slack position, the amount of the needle thread required for passing through a bobbin case is extended to the rotating looptaker with the tension equal to zero before the take-up lever descends to the same level with the thread suspending part of the thread suspending means, and then when a take-up lever further descends, the needle thread held by the thread guide of the thread take-up member is suspended by the thread suspending means installed in the middle of the thread passage, and thereafter an extra amount of the needle thread in the passage is absorbed and an extra amount of the needle thread is absorbed when the needle thread passes through the bobbin case, thereby proper tension is exerted on the needle thread when the thread is released from the rotation stopping member of the bobbin case, so that the needle thread may be taken out smoothly from the rotating looptaker with less noise.

Additionally, as the needle thread is not subjected to unnecessary variable tensile force upon taking up the needle thread, fine stitching can be obtained.

In cases where the thread suspending means is made up of a V-shaped thread suspending member supported pivotally on a machine frame at one end thereof and a torsion spring energizing the thread suspending member so as to move the thread suspending part upward, the needle thread held by the thread guide of the thread take-up member is suspended by the thread suspending part of the thread suspending member. A variation of the amount of the needle thread which is generated in accordance with oscillating displacement of the needle and the thickness of the needle thread around the looptaker, can be adjusted automatically so as to maintain stable thread condition by the thread suspending member which moves against the spring force. Accordingly, fine and stable stitches can be formed irrespectively of the type of the work fabric and the type of the needle thread.

DESCRIPTION OF THE PREFERRED EMBODIMENTS

Preferred embodiments of the present invention will be described hereinafter with reference to the accompanying drawings.

Figure 1:
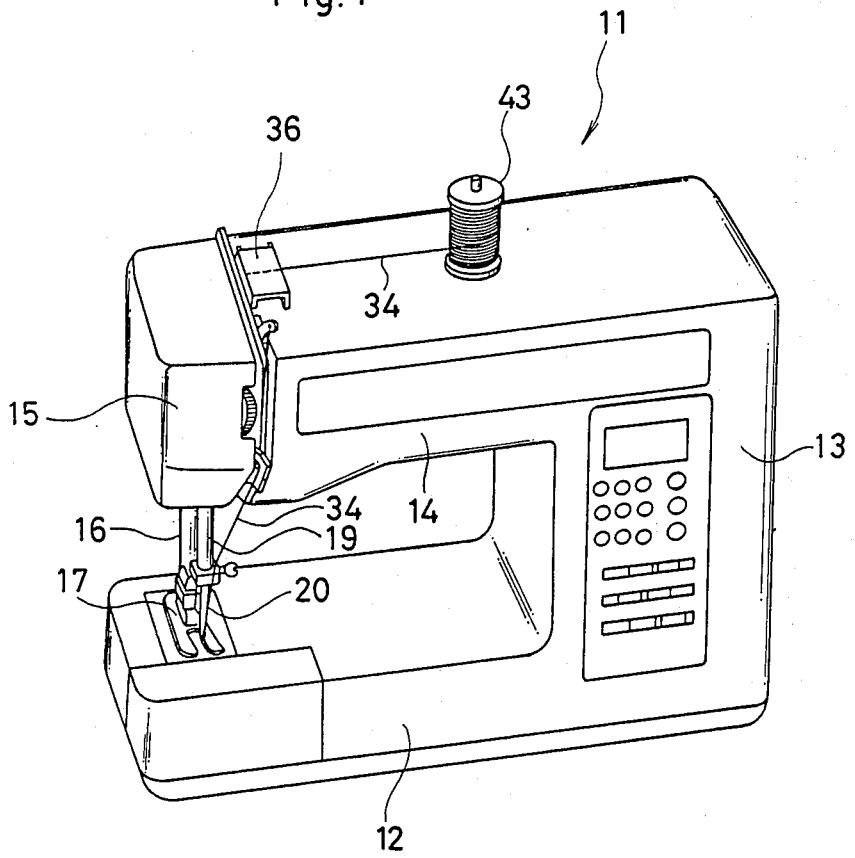
FIG. 1 is a schematic perspective view of a sewing machine incorporating a preferred embodiment of the present invention.

FIG. 1 illustrates an electronic lock stitch sewing machine 11 incorporating an embodiment of the present invention. Illustrated in FIG. 1 are a bed 12, a standard 13 extending upright from the right end of the bed 12, and an arm 14 horizontally extending from the upper end of the standard 13, overhanging the bed 12 and having a head 15 enclosed by a head cover at the left end thereof. In the head 15, a presser bar 16 is supported on the frame vertically movably by the lever (not shown) with a presser foot 17 attached at the lower end thereof, and also the needle bar 19 is supported vertically movably on a needle bar support 18 supported pivotally at the upper end thereof with a pin 22 on the frame so as to jog laterally by the well-known sewing mechanism.

The arm shaft 21 is supported rotatably in a bearing bush 23 or the like on the frame. An auxiliary shaft 24 is disposed above and behind the arm shaft 21 so as to extend in parallel to the same. The auxiliary shaft 24 is journaled on the frame. A swing lever 25 is supported swingably at one end thereof on the auxiliary shaft 24. The swing lever 25 extends from the auxiliary shaft 24 to the left side of a take-up lever crank 26 fixedly mounted on the arm shaft 21. The crankpin 27 of the take-up lever crank 26 extends through a cam slot 28 formed in the swing lever 25. A connecting plate 29 is fixed to the left end of the crankpin 27. The needle bar crank 31 is connected rotatably to the connecting plate 29 with a pin 30 extending leftward from the connecting plate 29. The needle bar crank 31 is connected at the lower end thereof to the middle part of the needle bar 19.

The upper part of the swing lever 25 is bent in a zigzag shape to form a take-up lever 32 (take-up member) which extends upward. A thread guide hole 35 holding a needle thread 34 through a slit 33 is formed at the free end of the take-up lever 32.

Figure 2:
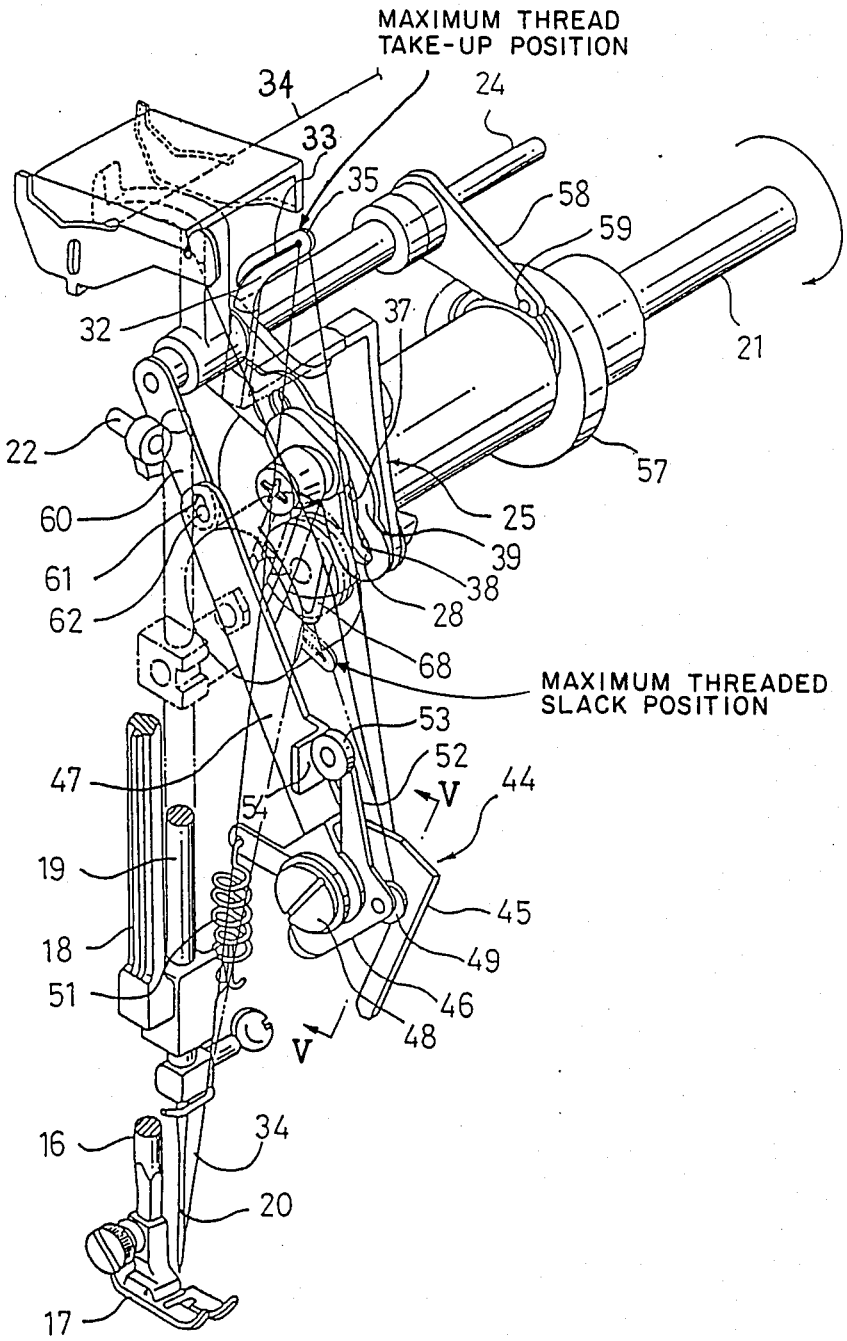
FIG. 2 is a perspective view of the essential portion of the internal mechanism built in the head of the sewing machine of FIG. 1.
Figure 3:
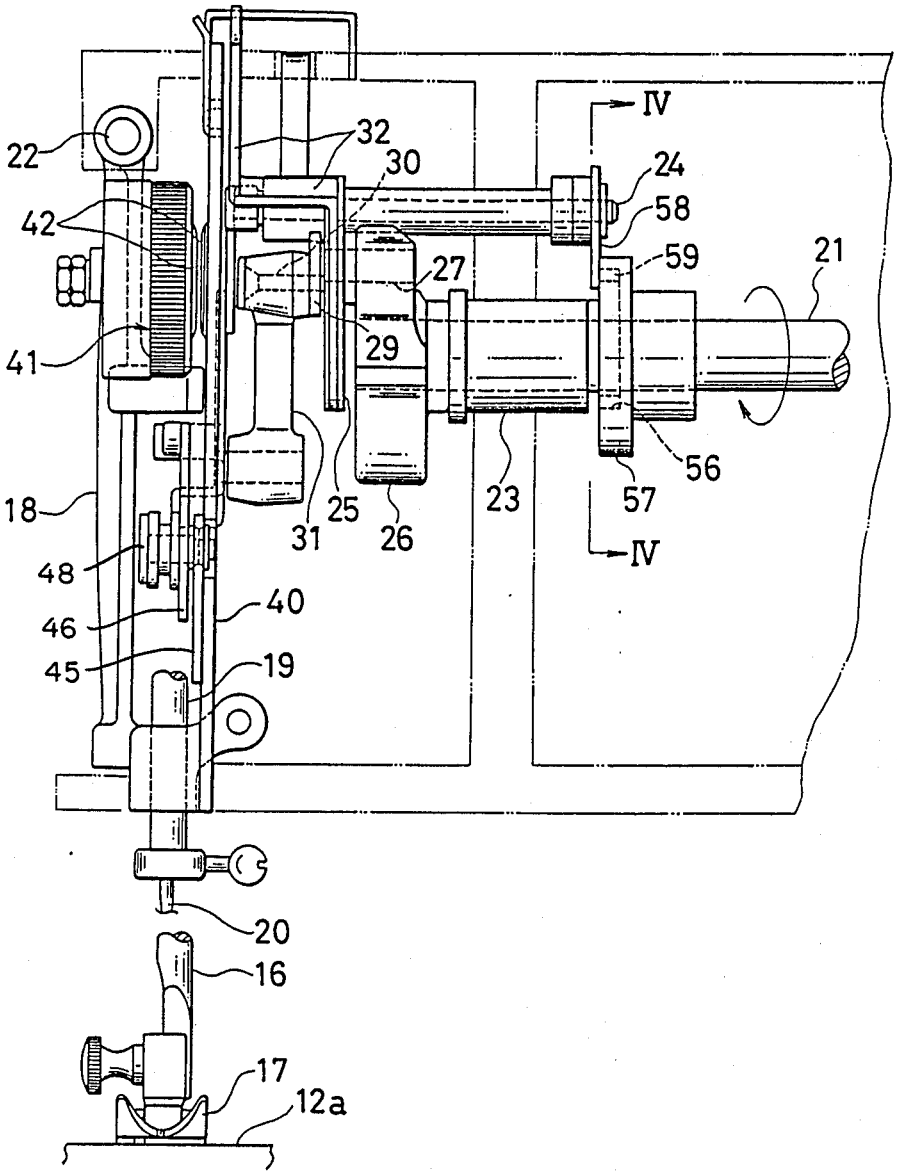
FIG. 3 is a front elevation of the internal mechanism of FIG. 2.
Figure 4:
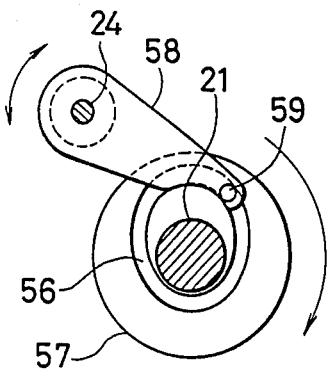
FIG. 4 is a sectional view taken on line IV—IV in FIG. 3.

As illustrated in FIGS. 2 and 3, the cam slot 28 of the swing lever 25 consists of a circular arc section 37 having a radius of curvature coinciding with the radius of the circular locus of the crankpin 27 and permitting the rotation of the crankpin 27 through an angle of approximately 74° in a range about the uppermost position of the crankpin 27, and short straight sections 38 extending from the opposite ends of the circular arc section 37, respectively. The cam slot 28 is reinforced along the periphery thereof with a reinforcement 39.

When the take-up lever crank 26 and the crankpin 27 are turned around the arm shaft 21 with the crankpin 27 engaging the cam slot 28 of the swing lever 25, the swing lever 25 is driven for reciprocatory swing motion about the auxiliary shaft 24 between an uppermost position indicated by continuous lines (FIG. 2) and a lowermost position (not shown) by the crankpin 27, while the needle bar 19 is driven for vertical reciprocatory motion through the needle bar crank 31 and the crankpin 27 by the arm shaft 21 in phase with the arm shaft 21.

A plate member 40 forming part of the frame is disposed near and on the lefthand side of the needle bar crank 31 disposed on the lefthand side of the arm shaft 21. The plate member 40 extends at right angles to the arm shaft 21. As illustrated in FIG. 2, a pretension device 41 for exerting a tension to the needle thread 34 is provided, when necessary, on the left side of the plate member 40 slightly before the arm shaft 21.

The pre-tension device 41 has a pair of tension discs 42 which exert a tension to the needle thread 34 passing therebetween. The tension of the needle thread 34 is adjusted by regulating spring force applied to the tension discs 42 by operating a dial.

A thread supply control device 44 which clamps or releases the needle thread 34 in synchronism with the rotation of the arm shaft 21 is provided in a thread path portion between a thread supply spool 43 and the thread guide hole 33 of the thread guide 35 of the take-up lever 32. The thread supply control device 44 comprises a thread guide plate 45, and a swing lever 46 provided with a thread clamping wheel 49. The thread guide plate 45 (thread clamping member) is secured to the left side of the plate member 40 at a position below the pre-tension device 41. The swing lever 46 is disposed adjacent to the left side of the thread guide plate 45 and is pivotally attached to the plate member 40 with a hinge screw 48. A link plate 47 also is pivotally attached at the lower end thereof to the plate member 40 with the hinge screw 48. The thread clamping wheel 49 (thread clamping member) held on the swing lever 46 engages the thread clamping edge 50 of the thread guide plate 45 to clamp the needle thread 34 between the thread clamping edge 50 and the thread clamping wheel 49. The swing lever 46 is biased resiliently by a spring 51 having one end connected to the frame and the other end connected to the swing lever so that the thread clamping wheel 49 is pressed against the thread clamping edge 50. A contact wheel 53 attached to the upper end of the arm 52 of the swing lever 46 is in contact with the front surface of a contact lug 54 formed near the lower end of the link plate 47.

Figure 5:
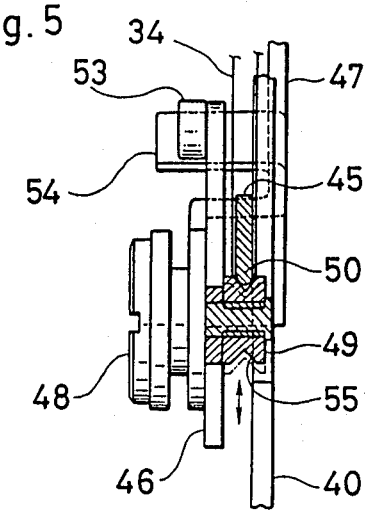
FIG. 5 is a sectional view taken on line V—V in FIG. 2.

As illustrated in FIGS. 2 and 5, an annular V-shaped groove 55 is formed in the circumference of the thread clamping wheel 49, while the thread clamping edge 50 of the thread guide plate 45 is formed in a U-shaped curve opening downward in a side view and in a U-shaped in section. The V-shaped groove 55 of the thread clamping wheel 49 and the U-shaped thread clamping edge 50 of the thread guide plate 45 engage to clamp the needle thread 34 therebetween.

After passing the pre-tension device 41, the needle thread 34 is turned by the U-shaped thread clamping edge 50 of the thread guide plate 45, and is guided via the thread guide hole 33 of the take-up lever 32 to the needle 20.

To drive the thread clamping wheel 49 in phase with the rotation of the arm shaft 21 toward and away from the thread clamping edge 50 to clamp and release the needle thread 34 alternately at predetermined phase angles of the arm shaft 21, a rotary cam 57 having an elliptic cam groove 56 is fixedly mounted on the arm shaft 21 at a position opposite the right end of the auxiliary shaft 24, and a cam follower 59 attached to the free end of a first arm 58 engages the cam groove 56.

On the other hand, a second arm 60 is fixedly mounted to the auxiliary shaft 24 at the left end of the same. A pin 62 attached to the free end of the second arm 60 is received in a slot 61 formed in the upper end of the link plate 47 to interconnect the second arm 60 and the link plate 47.

In the abovementioned thread supply control device 44, when the arm shaft 21 is rotated to swing the first arm 58 by the elliptic cam groove 56 of the rotary cam 57, the link plate 47 is reciprocated through the auxiliary shaft 24 and the second arm 60 on the hinge screw 48.

When the contact wheel 53 is pushed forward by the contact lug 54 of the link plate 47 as the link plate 47 is driven by the second arm 60, the swing lever 46 is turned against the resilient force of the spring 51, so that the thread clamping wheel 49 is separated from the thread clamping edge 50 of the thread guide plate 45 to release the needle thread 34. When the contact lug 54 of the link plate 47 is moved backward, the swing lever 46 is turned in the opposite direction by the spring 51, so that the thread clamping wheel 49 engages the thread clamping edge 50 to clamp the needle thread 34. Thus, the needle thread 34 is clamped and released alternately at predetermined phase angles, respectively.

During the upward movement of the take-up lever 32 from the lowermost position to the uppermost position for tightening the needle thread 34, the needle thread 34 is clamped between the thread guide plate 45 and the thread clamping wheel 49 so that the needle thread 34 is surely tightened. After the needle thread 34 has completely been tightened, the swing lever 46 is driven in phase with the feed motion to release and supply the needle thread 34. While the needle thread 34 is thus released free, the feed motion and the needle jogging motion are accomplished, and then the needle thread 34 is clamped again before the needle 20 arrives at the throat plate 12*a*.

Figure 6:
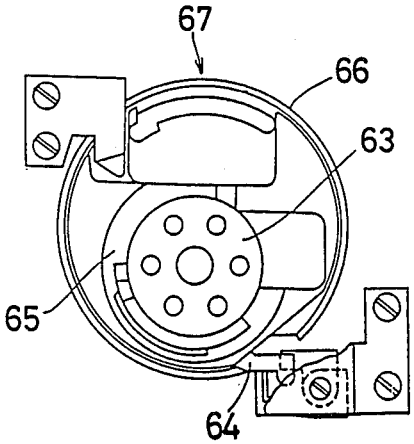
FIG. 6 is a front view of a rotating looptaker.
Figure 7:
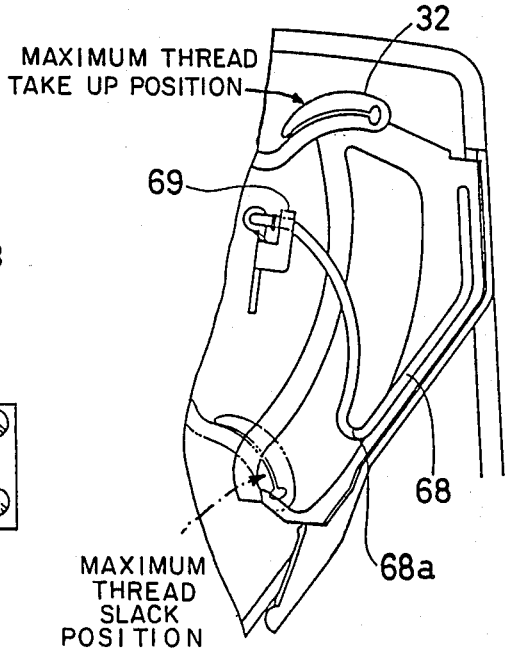
FIG. 7 is a side view showing the essential portion of the positional relation of the thread suspending member and the take-up lever.
Figure 6A:
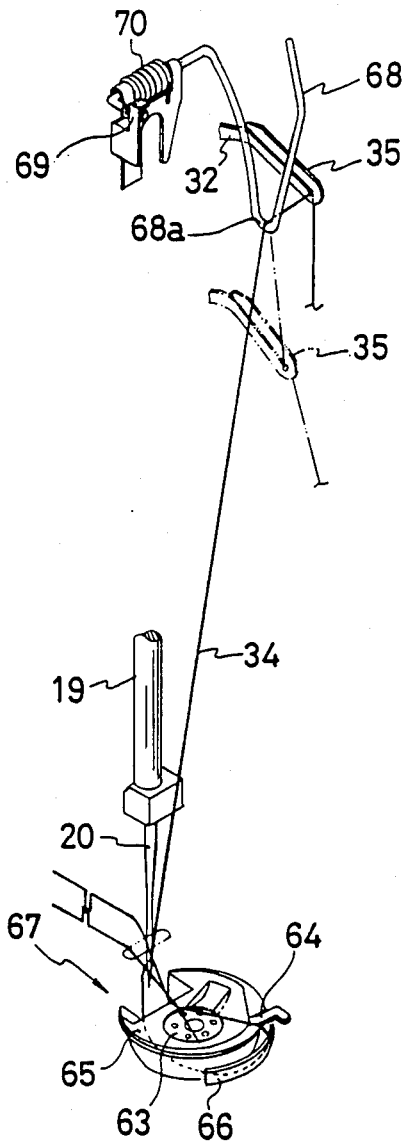
FIG. 6A is a schematic view depicting the relationship of the looptaker and the thread suspending member of the present invention.
Figure 8:
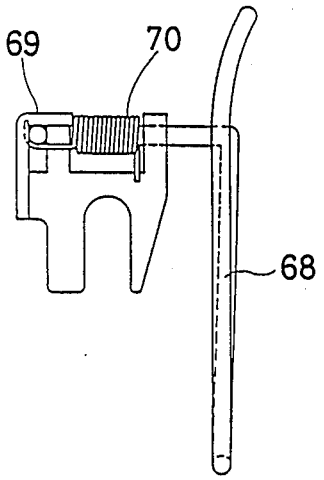
FIG. 8 is a front view of the thread suspending member.
Figure 9:
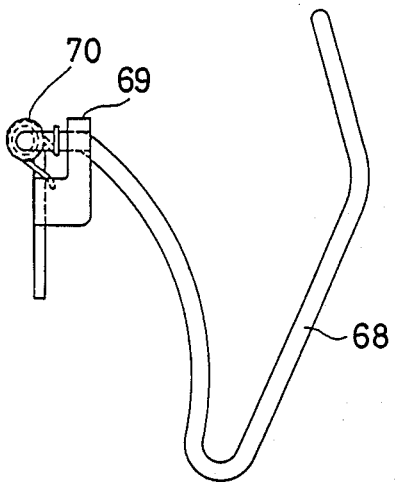
FIG. 9 is a side view of the thread suspending member.
Figure 10:
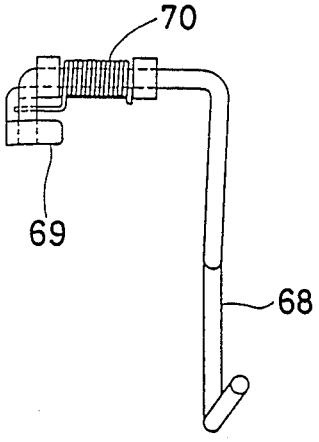
FIG. 10 is a plan view of the thread suspending member.

As shown in FIG. 6 and FIG. 6A, a bed 12 is provided with a rotating looptaker 67 composed of a bobbin case 65 which is restricted not to rotate by a rotation stopping member 64 and contains a bobbin 63 as a bobbin thread holder, and a looptaker 66 for seizing and enlarging a needle thread loop formed at the eye of the needle 20. Supply of the needle thread 34 to the rotating looptaker 67 may be achieved by the take-up lever 32 as a thread take-up member which moves toward the maximum slack position and then toward the maximum thread take up position to tighten the enlarged thread loop (see FIG. 6A).

In the vicinity of the specified position where the take-up lever 32 is located when the thread loop passes through the area between the rotation stopping member 64 and bobbin case 65 is disposed a thread suspending part 68*a* of a substantially V-shaped thread suspending member 68, as shown in FIGS. 6A and 7 to 10, which member 68 is mounted always urged by a coil spring 70 toward a position limited by a stopper 69 located in the side of the maximum thread take-up position. And when the take-up lever 32 moves from the maximum thread take-up position to the maximum thread slack position, the needle thread 34 is suspended by the thread suspending part 68*a* of thread suspending member 68.

Figure 11:
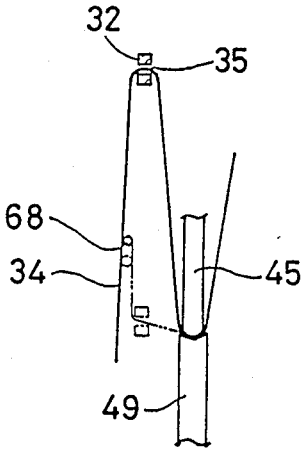
FIG. 11 is a view schematically showing operation of the thread suspending member.

As the auxiliary thread take-up device has such an arrangement as described above, as illustrated in FIG. 11, when the take-up lever 32 is moved within the range from the maximum thread take-up position down to the maximum thread slack position, the needle thread 34 held by the thread guide 35 of take-up lever 32 is suspended by the thread suspending part 68*a* located midway of the thread passage.

Consequently, a variation of the amount of the needle thread 34 which is generated in accordance with oscillating displacement of the needle 20 and the thickness of the needle thread 34 around the looptaker 66, can be adjusted automatically so as to maintain stable thread condition by the thread suspending member 68 which moves against the spring force. When the take-up lever 32 is lifted toward the maximum thread take-up position, the needle thread 34 can be tightened in an appropriate manner, independent from the force of the coil spring 70, with a suitable amount of the needle thread 34 controlled by the thread supply control device 44.

As a result, fine and stable stitches can be formed irrespectively of the types of fabrics to be sewn and of needle thread 34 used. When the loop of the needle thread 34 passes through the area between the rotation stopping member 64 and the bobbin case 65, the needle thread 34 is suspended by the thread suspending member 68 biased by the coil spring 70. This suspension brings about a suitable degree of a tension on the needle thread loop, and thus the needle thread 34 can smoothly be taken out of the rotating looptaker 67, and noises caused upon taking out the needle thread 34 from the rotating looptaker 67 can be decreased, irrespectively of oscillating displacement of the needle 20 and the thickness of the needle thread 34.

Now, a modification using another thread suspending pin instead of the thread suspending member 68 in the foregoing embodiment will be described in conjunction with FIGS. 12 to 14. In addition, each same member with that of above-described embodiment is given the same numeral in FIGS. 12 to 14.

Figure 12:
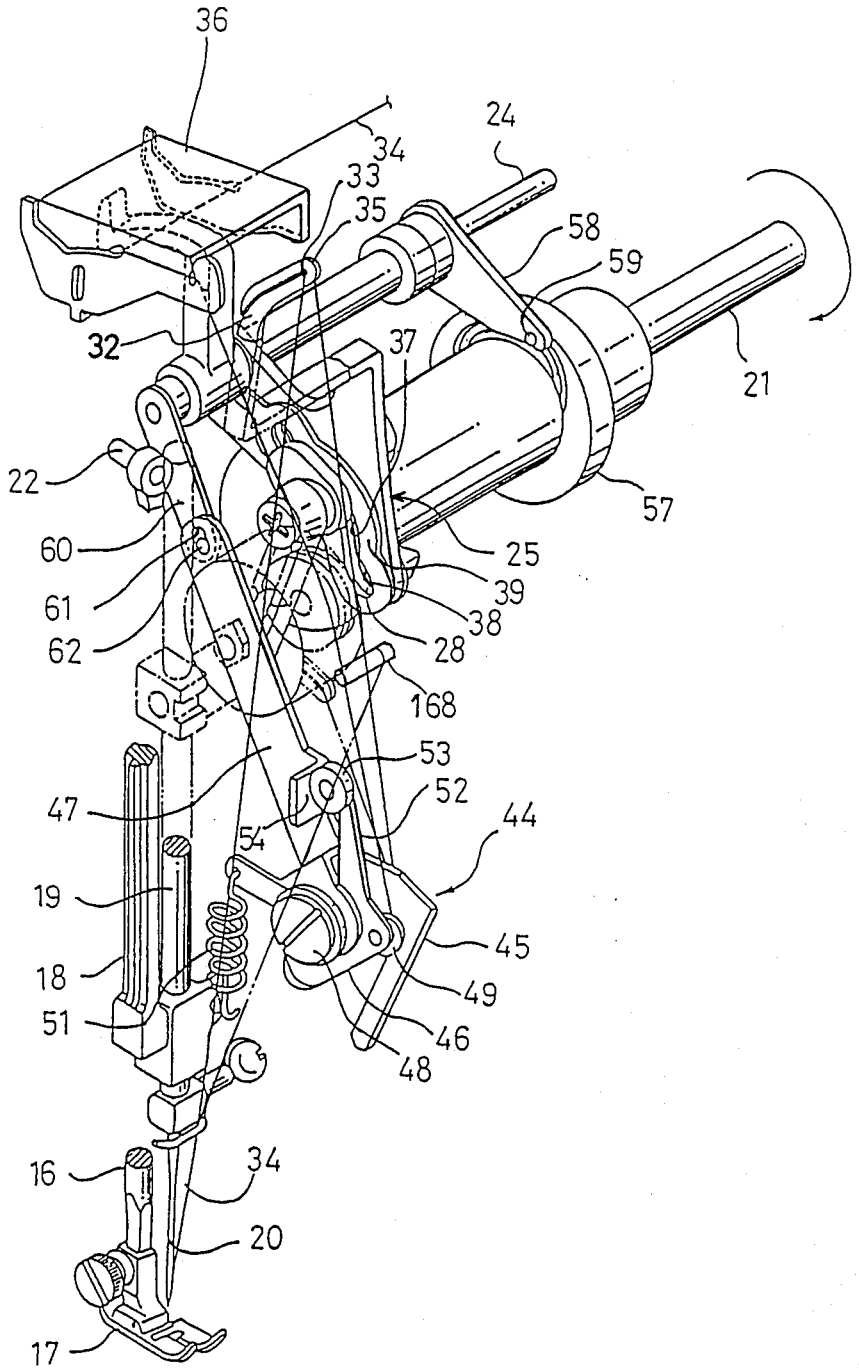
FIG. 12 is a perspective view of the essential portion of the modified internal mechanism provided with a thread suspending pin built in the head of the sewing machine of FIG. 1.
Figure 13:
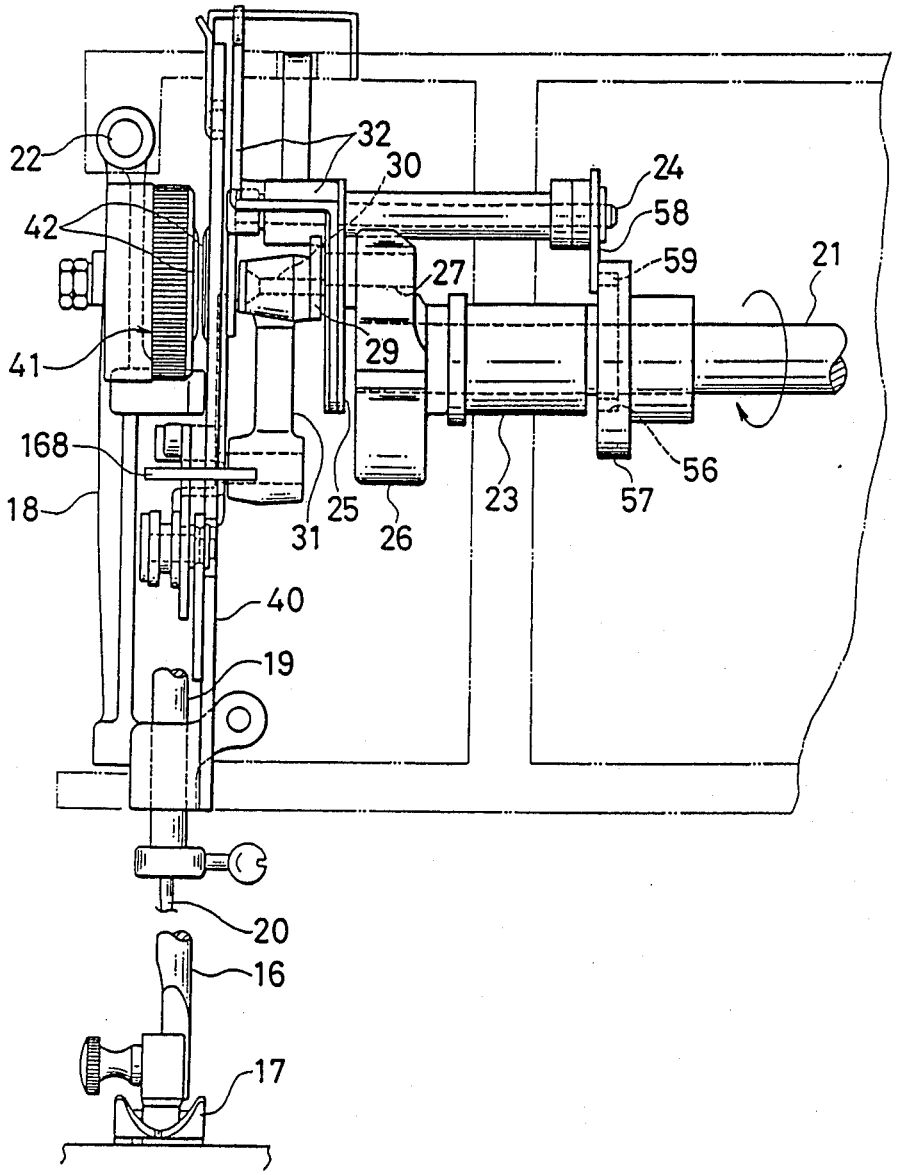
FIG. 13 is a front elevation of the internal mechanism of FIG. 12.
Figure 14:
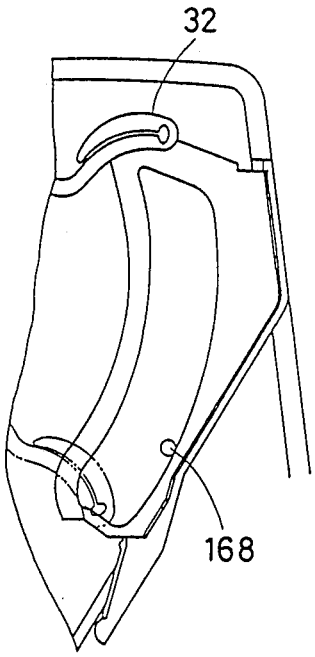
FIG. 14 is a side view of the essential portion of the positional relation between the thread suspending pin and the take-up lever.
Figure 15:
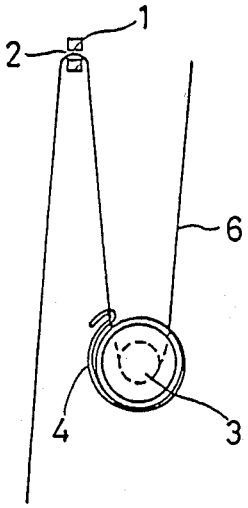
Fig.15 (Prior Art)
FIGS. 15 and 16 are views showing the spring adjusting mechanism for the thread take-up spring according to the prior art.
Figure 16:
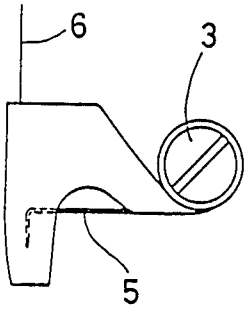
Fig.16 (Prior Art)
Figure 17:
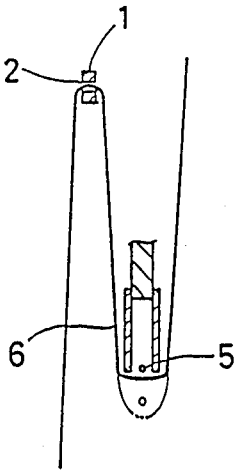
Fig.17 (Prior Art)
FIG. 17 is a front view of the spring adjusting mechanism of FIG. 16.

As illustrated in FIGS. 12 to 14, near a specific position in which said take-up lever 32 is placed when a thread loop passes through the area between said rotation stopping member 64 and the bobbin case 65 and ahead of the take-up lever 32 is disposed and mounted a thread suspending pin 168 as a thread suspending means on the machine frame. The thread suspending pin 168 serves to suspend the needle thread 34 held by the thread guide 35 of the take-up lever 32 when the take-up lever 32 travels from said maximum thread take-up position to the maximum thread slack position. The thread suspending pin 168 is disposed so as to extend horizontally at a right angle to a movement locus of the thread guide 35 in front of the movement locus.

In such an auxiliary thread take-up device as arranged, when the take-up lever 32 is moved down within the predetermined range between the maximum thread take-up position and the maximum thread slack position, the needle thread 34 held by the thread guide 35 of the take-up lever 32 is suspended by the thread suspending pin 168 positioned midway of the thread passage and thereafter, an extra amount of the needle thread will be absorbed.

During ascending motion of the take-up lever 32 toward the maximum thread take-up position, the needle thread 34 is disengaged from the thread suspending pin 168, since there exists no element, such as the conventional thread take-up spring, for imparting unnecessary tension to the needle thread 34, the movement of the needle thread is rendered stable to ensure that the stitches are tightened to an adequate extent.

By absorbing an extra amount of the needle thread 34 leaving the bobbin case 65 and giving a suitable tension to the needle thread 34 when the same is released from the suspension, the needle thread 34 can be taken out of the rotating loop taker 67 smoothly so that it is possible to decrease noise generated when the thread 34 is taken out from the bobbin case 65.

What is claimed is:

1. A thread checking device in combination with a sewing machine having an endwise reciprocatory needle with an eye; a bobbin with a bobbin thread; a rotating looptaker comprising a bobbin case which contains said bobbin and is restrained not to rotate by a rotation stopping member, a looptaker which is rotated to seize and enlarge a needle thread loop formed at the eye of the needle; and a thread take-up member movable between a minimum thread slack position and a maximum thread take-up position and being provided with a thread guide for holding a needle thread;

said thread checking device comprising:

thread suspending means which is provided with a thread suspending part disposed near a specified position where said thread guide of said thread take-up member is located when said needle thread loop passes between said rotation stopping member and said bobbin case, and means for maintaining said thread suspending part to be out of engagement with said needle thread when said thread take-up member is in said maximum thread take-up position and for permitting said thread suspension part to engage said needle thread during movement of the thread take-up member from said maximum thread slack position, whereby proper tension is extended on the thread loop formed at the eye of the needle during sewing machine operation.

2. A thread checking device according to claim 1; wherein said thread suspending means is made up of a V-shaped thread suspending member supported pivotally on a machine frame at one end thereof and a torsion spring biasing said thread suspending member so as to move said thread suspending part in a direction which said take-up member moves from said maximum thread slack position to said maximum thread take-up position.

3. A thread checking device according to claim 1; wherein said sewing machine further comprises a pair of thread clamping members movable toward and away from each other for checking and permitting supply of the needle thread, and a thread path portion extending from said pair of thread clamping members to the eye of the needle through said thread guide of said thread take-up member.

4. A thread checking device according to claim 3; wherein said pair of thread clamping members are constituted to move toward each other for checking supply of the needle thread when said suspending means suspends the needle thread with said thread suspending part.

5. A thread checking device according to claim 4; wherein said thread suspending part is constituted to suspend the needle thread extending from said thread guide to the eye of the needle.

6. A thread checking device according to claim 1; wherein said thread suspending means is made up of a thread suspending pin fixed on a sewing machine frame at one end thereof.

7. A thread checking device according to claim 6; wherein said thread suspending pin is disposed so as to extend horizontally at a right angle to a movement locus of said thread guide.

8. A thread checking device according to claim 6; wherein said thread suspending pin is constituted to suspend the needle thread extending from said thread guide to the eye of the needle.

* * * * *

UNITED STATES PATENT AND TRADEMARK OFFICE

CERTIFICATE OF CORRECTION

PATENT NO. : 4,856,443

DATED : August 15, 1989

INVENTOR(S) : Masao Ogawa et al

It is certified that error appears in the above-identified patent and that said Letters Patent is hereby corrected as shown below:

On the title page assignee should read

--(73) Assignee: Brother Kogyo Kabushiki Kaisha --.

Signed and Sealed this

Twenty-fifth Day of September, 1990

*Attest:*

HARRY F. MANBECK, JR.

*Attesting Officer*

*Commissioner of Patents and Trademarks*